US009590330B2

(12) United States Patent
Liao

(10) Patent No.: US 9,590,330 B2
(45) Date of Patent: Mar. 7, 2017

(54) ELECTRICAL CONNECTOR

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/790,346

(22) Filed: Jul. 2, 2015

(65) Prior Publication Data

US 2016/0006177 A1 Jan. 7, 2016

(30) Foreign Application Priority Data

Jul. 3, 2014 (TW) ..... 103211796 U

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 13/645*** | (2006.01) |
| *H01R 12/50* | (2011.01) |

(52) U.S. Cl.

CPC ..... *H01R 12/7076* (2013.01); *H01R 12/714* (2013.01); *H01R 13/6456* (2013.01); *H01R 23/6806* (2013.01)

(58) Field of Classification Search

USPC ..... 439/75, 374, 526

See application file for complete search history.

(56) References Cited

U.S. PATENT DOCUMENTS

| | | | | |
|---|---|---|---|---|
| 6,659,795 | B1 * | 12/2003 | Lai | H05K 7/1061 439/526 |
| 6,881,073 | B2 * | 4/2005 | Bali | H01R 13/2414 439/594 |
| 7,059,869 | B2 * | 6/2006 | Wertz | H01R 13/24 439/66 |
| 7,196,907 | B2 * | 3/2007 | Zheng | H01R 13/2435 361/760 |
| 7,338,294 | B2 * | 3/2008 | Polnyi | H01R 13/2421 439/66 |
| 7,341,460 | B1 * | 3/2008 | McHugh | H01R 12/7047 439/569 |
| 7,637,775 | B2 * | 12/2009 | Chang | H01R 13/502 439/331 |

(Continued)

*Primary Examiner* — Tho D Ta

(74) *Attorney, Agent, or Firm* — Wei Te Chung; Ming Chieh Chang

(57) ABSTRACT

An electrical connector socket includes an insulative housing forming a plurality of passageways extending through the opposite top and bottom surfaces of the housing. A plurality of contacts are disposed in the corresponding passageways, respectively. Each of the contacts includes opposite upper and lower contacting sections extending beyond the top surface and the bottom surface respectively. First and second upper posts extend upwardly from the top surface around two opposite corners and are different and spaced from each other diagonally. First and second lower posts extend downward from the bottom surface around the same two opposite corners and are different and spaced from each other diagonally.

12 Claims, 5 Drawing Sheets

(56) References Cited

U.S. PATENT DOCUMENTS

| | | | | |
|---|---|---|---|---|
| 7,740,488 | B2 * | 6/2010 | Taylor | H01R 12/714 439/66 |
| 2007/0149023 | A1 * | 6/2007 | Hsieh | H05K 7/1053 439/188 |
| 2012/0115350 | A1 | 5/2012 | Liao et al. | |

* cited by examiner

ELECTRICAL CONNECTOR

FIELD OF THE INVENTION

The present invention relates to an electrical connector, and more particularly to an electrical connector connected between an electronic package and printed circuit board.

DESCRIPTION OF THE PRIOR ART

A traditional socket connector for connecting an electronic package to a printed circuit board, includes an insulative housing with therein a plurality of contacts arranged in matrix wherein each contact forms an upper resilient contacting section and a lower resilient contacting section respectively extending out of the opposite top and bottom surfaces of the housing for respectively connecting to the electronic package and the printed circuit board. Generally, the housing is further equipped with a pair of alignment pins extending beyond the top surface to couple with the corresponding cutouts of the electronic package for aligning the electronic package to the housing, and with a pair of mounting legs extending downwardly for mounting to the printed circuit board. Anyhow, the positions and the configurations and the dimensions of the pair of alignment pins and those of the pair of mounting legs are essentially significantly different from each other. Due to the significant differences, when the housing is under a relatively hot condition, the inherent expansion may occur in an asymmetrical manner around the locations of said pair of alignment pins and those of the mounting legs disadvantageously, thus affecting the reliability of the alignment effect and that of the mounting effect.

It is desired to obtain a new electrical socket with the associated alignment pins and mounting legs to be in an even expansion under a heated situation so as to maintain precise locations of the corresponding alignment pins and those of the mounting pins for assuring the alignment and mounting effects thereof.

SUMMARY OF THE INVENTION

Accordingly, an object of the present invention is to provide an electrical connector with a symmetrical arrangement in a vertical direction so as to assure the upwardly extending alignment/mounting posts and the downwardly extending alignment/mounting posts are correctly positioned in a heated situation.

In order to achieve the object set forth, an electrical connector socket includes an insulative housing forming a plurality of passageways extending through the opposite top and bottom surfaces of the housing. A plurality of contacts are disposed in the corresponding passageways, respectively. Each of the contacts includes opposite upper and lower contacting sections extending beyond the top surface and the bottom surface respectively. First and second upper posts extend upwardly from the top surface around two opposite corners and are different and spaced from each other diagonally. First and second lower posts extend downward from the bottom surface around the same two opposite corners and are different and spaced from each other diagonally. The first upper post and the first lower post are dimensionally and configurationally same with each other in a symmetrical manner with regard to the housing in the vertical direction, and the second upper post and the second lower post are dimensionally and configurationally same with each other in a symmetrical manner with regard to the housing in the vertical direction.

DESCRIPTION OF PREFERRED EMBODIMENT

Reference will now be made to the drawings to describe the present invention in detail.

Figure 1:
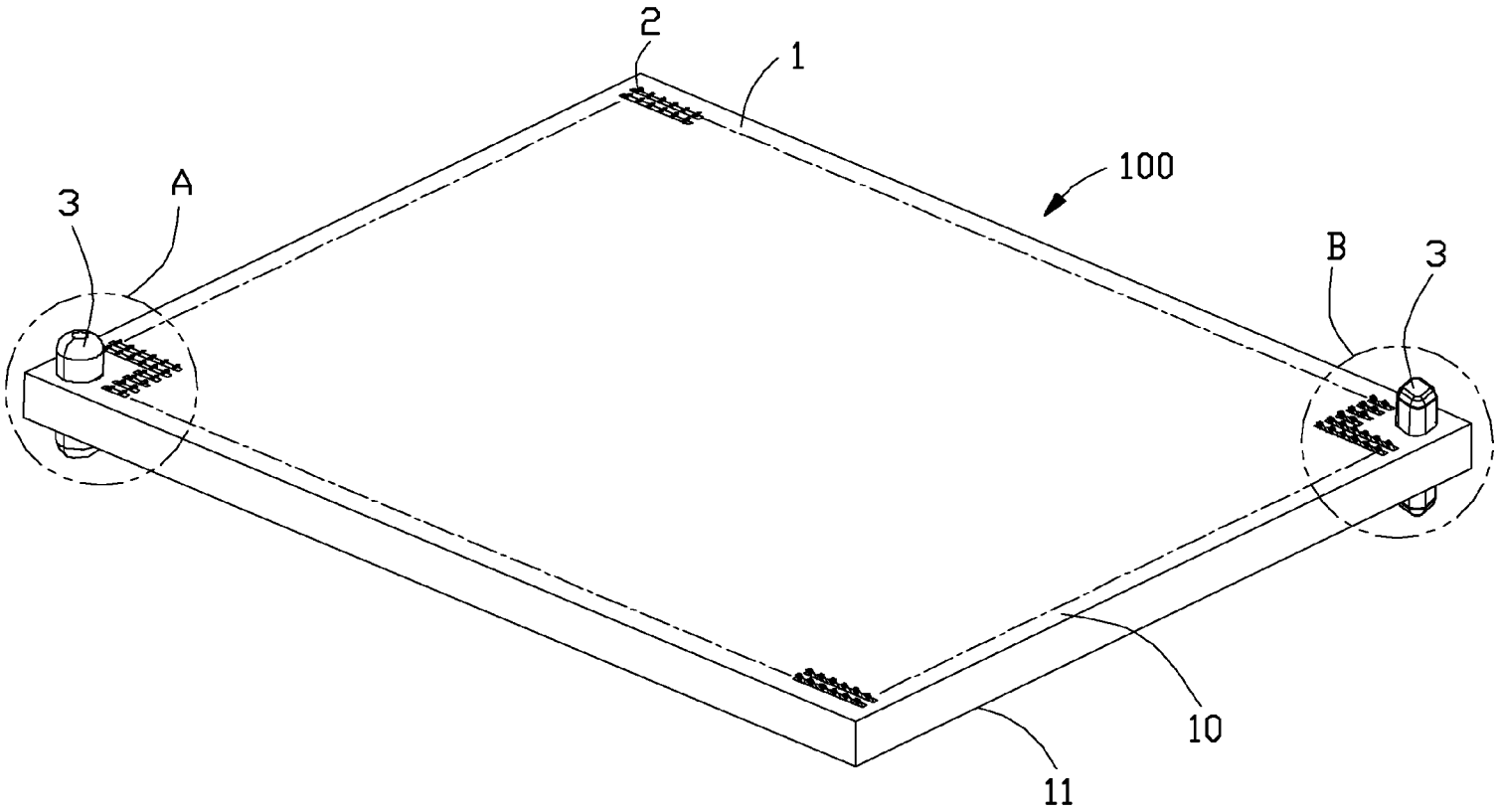
FIG. 1 is an assembled perspective view of an electrical connector in accordance with a preferred embodiment of the present invention.
Figure 2:
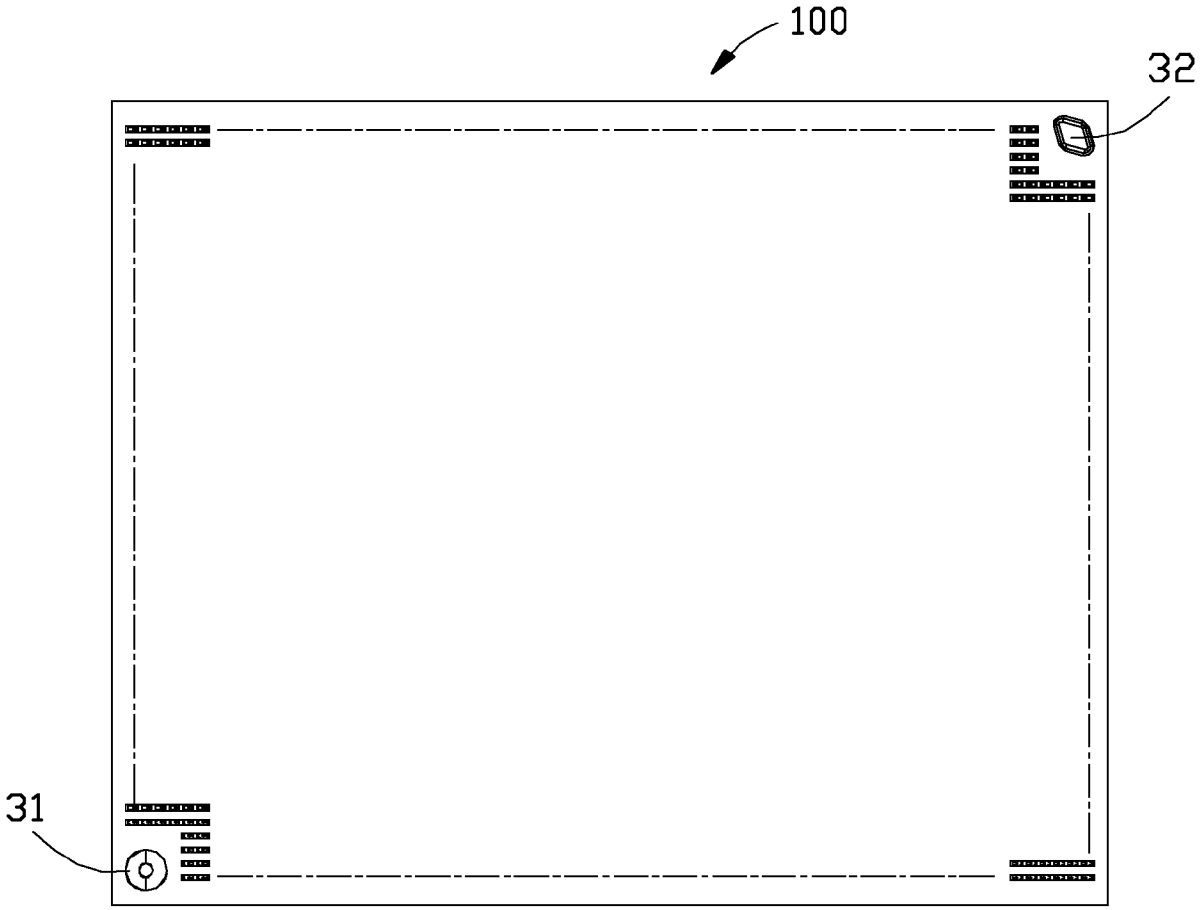
FIG. 2 is a top view of the electrical connector of FIG. 1.
Figure 3:
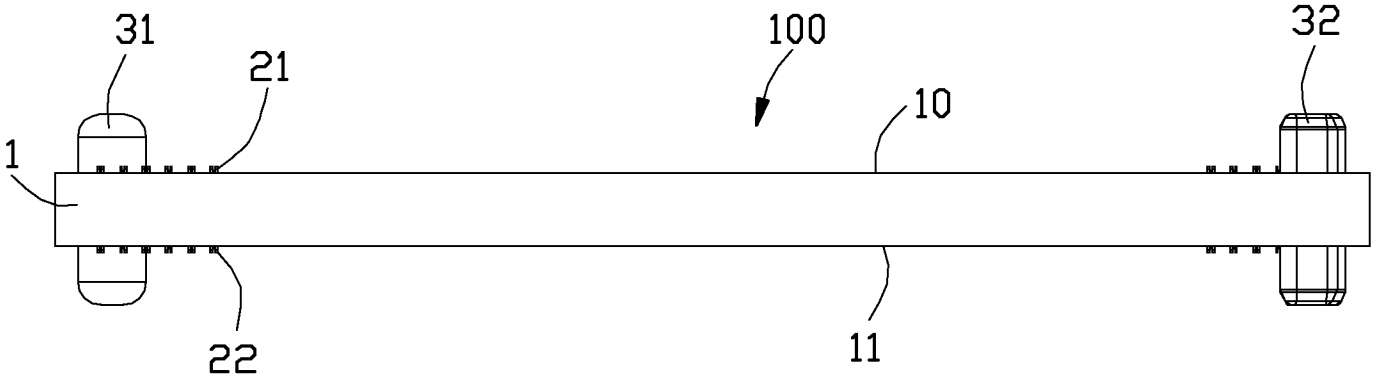
FIG. 3 is a side view of the electrical connector of FIG. 1.
Figure 4:
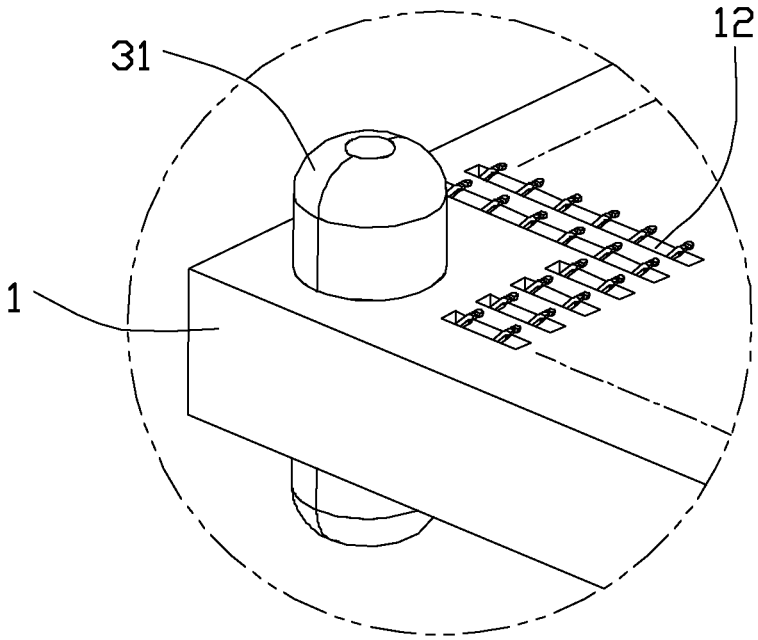
FIG. 4 is an enlarged perspective view of a first corner of the electrical connector of FIG. 1.
Figure 5:
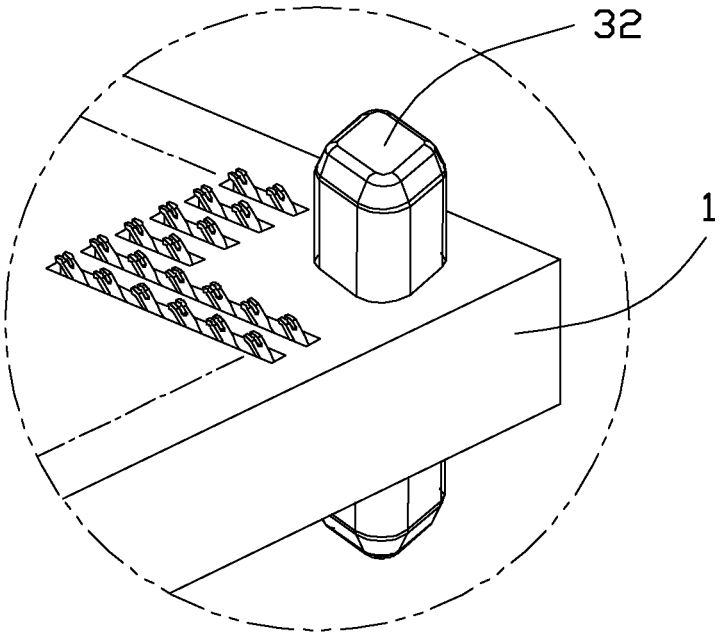
FIG. 5 is an enlarged perspective view of the electrical connector of FIG. 1.

Referring to FIGS. 1-5, an electrical connector 100 includes a planar insulative housing 1 with opposite top surface 10 and bottom surface 11. A plurality of passageways 12 is formed in the housing 1 and extending through both the top surface 10 and the bottom surface 11. A plurality of contacts 2 are respectively disposed in the corresponding passageways 12. Each contact has an upper contacting section 21 extending upwardly above the top surface 10, and a lower contacting section 22 extending downwardly below the bottom surface 11 wherein the upper contacting section 21 and the lower contacting section 22 are symmetrical with each other in respect with the housing 1.

A alignment post structure 3 includes a first alignment post 31 and a second alignment post 32 located at two opposite diagonal corners of the housing 1. The first alignment post 31 has a circular cross-section and extends through the housing 1 with two opposite ends extending beyond the opposite top surface 10 and bottom surface 11 with a same distance so as to be in a symmetrical manner with regard to the housing 1. The second alignment post 32 has a diamond-shaped cross-section and extends through the housing 1 with two opposite ends extending beyond the opposite top surface 10 and the bottom surface 11 with the same distance so as to be in a symmetrical manner with regard to the housing 1. Understandably, the different cross-sectional configurations between the first alignment post 31 and the second alignment post 32 assures only one orientation for mounting the corresponding electronic package thereto for foolproof consideration.

Notably, the first alignment post 31 can be made by plastic unitarily formed with the housing 1, or by metal retained to the housing 1 either in an assembling process or via an insert-molding process, and the first alignment post 31 may be either hollow or solid. Furthermore, the upper part of the first alignment post 31, which extends above the top surface 10 of the housing 1, and the lower part of the first alignment post 31, which extends below the bottom surface 11 of the housing 1, may be discrete from each other. The structure of the second alignment post 32 may be arranged with regard to the housing 1 as well as that of the first alignment post 31.

In the instant invention, because the upper part and the lower part of the first alignment post 31 is symmetrical with regard to the housing 1 in the vertical direction, and those of the second alignment post 32 is also symmetrical with regard to the housing 1 in the vertical direction, the housing 1 may experience the even expansion under a heated condition, thus assuring the correct and precise position and configuration of the corresponding first alignment post 31 and the second alignment post 32 with regard to the housing 1 in a harsh/heated condition. On the other hand, because of the symmetrical arrangement of the first alignment post 31 and the second alignment post 32 with regard to the housing 1 in the vertical direction, it is relatively easy and reliable for forming the housing 1 via an injection molding process, compared with the traditional one which uses different alignment/mounting post structures on opposite top and bottom surfaces of the housing.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a planar insulative housing forming a plurality of passageways extending through opposite top and bottom surfaces of the housing in a vertical direction;

a plurality of contacts disposed in the corresponding passageways, respectively, each of said contacts defining opposite resilient upper and lower contacting section extending beyond the opposite top and bottom surfaces;

a first alignment post and a second alignment post located at opposite diagonal corners of the housing, the first alignment post extending through the housing with two opposite first upper and lower parts extending beyond the opposite top and bottom surfaces, respectively, and the second alignment post extending through the housing with two opposite second upper and lower parts extending beyond the opposite top and bottom surfaces, respectively; wherein a cross-section of the first alignment post and that of the second alignment post are different from each other; wherein the cross-section of the first alignment post is circular while the cross-section of the second alignment post is of a diamond shape.

2. The electrical connector as claimed in claim 1, wherein the opposite first upper part and first lower part are symmetrical with each other with regard to the housing in the vertical direction, and the opposite second upper part and second lower part are symmetrical with each other with regard to the hosing in the vertical direction.

3. The electrical connector as claimed in claim 1, wherein the upper contacting sections and the lower contacting sections are symmetrical with each other with regard to the housing in the vertical direction.

4. The electrical connector as claimed in claim 1, wherein said first alignment post is either made by metal and discrete from the housing, or made by plastic and unitarily formed with the housing.

5. The electrical connector as claimed in claim 1, wherein the whole connector including the housing, the contacts and the first alignment post and the second alignment post, is symmetrically arranged in the vertical direction with regard to an imaginary center horizontal plane of the housing.

6. An electrical connector comprising:

a planar insulative housing forming a plurality of passageways extending through opposite top and bottom surfaces of the housing in a vertical direction;

a plurality of contacts disposed in the corresponding passageways, respectively, each of said contacts defining opposite resilient upper and lower contacting section extending beyond the opposite top and bottom surfaces;

a first upper alignment post and a second upper alignment post being respectively extending upwardly from the top surface around two opposite diagonal corners, the first upper alignment post and the second upper alignment post having different cross-sections from each other;

a first lower alignment post and a second lower alignment post being respectively extending downwardly from the bottom surface around said two opposite diagonal corners, wherein the first upper alignment post and the first lower alignment post having a same cross-section are symmetrically arranged with each other with regard to the housing in the vertical direction, and the second upper alignment post and the second lower alignment post having another same cross-section are symmetrically arranged with each other with regard to the housing in the vertical direction; wherein the same cross-section of the first upper alignment post and the first lower alignment post is circular while the same cross-section of the second upper alignment post and the second lower alignment post is of a diamond shape.

7. The electrical connector as claimed in claim 6, wherein the first upper alignment post and the first lower alignment post are discrete from the housing, and the second upper alignment post and the second lower alignment post are discrete from the housing.

8. The electrical connector as claimed in claim 6 wherein said upper contacting sections and said lower contacting sections are symmetrical with each other with regard to the housing in the vertical direction.

9. The electrical connector as claimed in claim 6, wherein the whole connector including the housing, the contacts and the first upper alignment post, the first lower alignment post, the second upper alignment post and the second lower alignment post, is symmetrically arranged in the vertical direction with regard to an imaginary center horizontal plane of the housing.

10. The electrical connector as claimed in claim 6, wherein with regard to a center of the housing, an orientation of the second upper alignment post and that of the second lower alignment post are same with each other.

11. The electrical connector as claimed in claim 6, wherein the first upper alignment post and the first lower alignment post are integrally formed with each other in the vertical direction, and the second upper alignment post and the second lower alignment post are integrally formed with each other in the vertical direction.

12. An electrical connector comprising:

a planar insulative housing forming a plurality of passageways extending through opposite top and bottom surfaces of the housing in a vertical direction;

a plurality of contacts disposed in the corresponding passageways, respectively, each of said contacts defining opposite resilient upper and lower contacting section extending beyond the opposite upper and bottom surfaces;

a large upper alignment post and a small upper alignment post being respectively extending upwardly from the top surface around two opposite diagonal corners;

a large lower alignment post and a small lower alignment post being respectively extending downwardly from the bottom surface around said two opposite diagonal corners, wherein the large upper alignment post and the large lower alignment post having a same first cross-section are symmetrically arranged with each other with regard to the housing in the vertical direction, and the small upper alignment post and the small lower alignment post having a same second cross-section are symmetrically arranged with each other with regard to the housing in the vertical direction; wherein the first cross-section is circular without an orientation in a plane while the second cross-section has a shape with the orientation in the plane.

* * * * *